US006571419B1

(12) United States Patent
Lee

(10) Patent No.: US 6,571,419 B1
(45) Date of Patent: Jun. 3, 2003

(54) MOP WITH A SUCKING PLATE AND A MOP UNIT HAVING CHANGEABLE SOFT AND COARSE SPONGE SIDES

(75) Inventor: Pei-Yuan Lee, Changhua Hsien (TW)

(73) Assignee: Chien-Chan Enterprise Co., Ltd., Chunghua Hsien (TW)

( * ) Notice: Subject to any disclaimer, the term of this patent is extended or adjusted under 35 U.S.C. 154(b) by 0 days.

(21) Appl. No.: 09/569,873

(22) Filed: May 12, 2000

(51) Int. Cl.[7] ..... A47K 7/02; A47L 13/46; B43L 21/00

(52) U.S. Cl. ..... 15/244.2; 15/244.1; 15/244.3; 15/210.1; 15/220.1; 15/228

(58) Field of Search ..... 15/244.1, 244.2, 15/210.1, 220.1, 228, 144.1, 144.2, 121, 118, 244.3; 248/205.5, 205.7, 206.2, 363

(56) References Cited

U.S. PATENT DOCUMENTS

| | | | | | |
|---|---|---|---|---|---|
| 2,682,071 | A | * | 6/1954 | Linderoth | 15/147.2 |
| 2,727,268 | A | * | 12/1955 | Hucke | 15/229.8 |
| 2,736,913 | A | * | 3/1956 | Mirth | 15/231 |
| 4,455,705 | A | * | 6/1984 | Graham | 15/121 |
| 5,876,141 | A | * | 3/1999 | Hsu | 15/144.2 |

FOREIGN PATENT DOCUMENTS

| | | | | |
|---|---|---|---|---|
| CH | 472 880 | * | 7/1969 | A47I/1/08 |
| GB | 1156161 | * | 9/1969 | A47I/13/20 |
| GB | 1214774 | * | 12/1970 | A47I/1/06 |

* cited by examiner

*Primary Examiner*—Robert J. Warden, Sr.
*Assistant Examiner*—Laura C Cole
(74) *Attorney, Agent, or Firm*—Bacon & Thomas

(57) ABSTRACT

An improved mop which is equipped with a long handle, a connector, a torsion spring, a rivet, a securing ring, a coarse sponge, a soft sponge, a fixing seat, a washer ring, a sucking plate and a screen housing. The front end of the long handle is provided with bifurcated connecting lugs each having a pivot hole so as to permit the bifurcated connector to be pivotally fixed to the handle. An externally threaded journal end is disposed at the bottom of the connector. The securing ring of a proper thickness sandwiched between the soft and coarse sponge is provided with a tubular central hole with internal threads defined therein so as to permit the connector to be removably engaged with the securing ring. The fixing seat is tubular in shape and has an opened end with an engagement cavity defined at the closed bottom end thereof so as to permit the sucking plate provided with a raised block, a pull piece disposed at a periphery edge thereof to be engaged with a pulling cord. Thereby the mop can be firmly retained on a floor or a glass surface in use. Besides, the mop unit can be selectively operated with a soft and coarse sponge.

3 Claims, 7 Drawing Sheets

MOP WITH A SUCKING PLATE AND A MOP UNIT HAVING CHANGEABLE SOFT AND COARSE SPONGE SIDES

BACKGROUND OF THE INVENTION

The present invention relates to an improved mop which is equipped with a long handle, a connector, a torsion spring, a rivet, a securing ring, a coarse sponge, a soft sponge, a fixing seat, a washer ring, a sucking plate and a screen housing. The front end of the long handle is provided with bifurcated connecting lugs each having a pivot hole so as to permit the bifurcated connector to be pivotally fixed to the handle. An externally threaded journal end is disposed at the bottom of the connector. The securing ring of a proper thickness sandwiched between the soft and coarse sponge is provided with a tubular central hole with internal threads defined therein so as to permit the connector to be removably engaged with the securing ring. The fixing seat is tubular in shape and has an opened top end with an engagement cavity defined at the closed bottom end thereof, so as to permit the sucking plate provided with a raised block, a pull piece disposed at a periphery edge thereof to be engaged with a pulling cord. Thereby the mop can be firmly retained on a floor or a glass surface in use. Besides, the mop unit can be selectively operated with a soft and coarse sponge.

In general, a common multi-purpose mop, as shown in FIG. 1, has a long handle 11 equipped with a mop unit 12 at the front end thereof. At one side of the mop unit 12 is disposed a mopping sponge 13 and at the other side of the mop unit 12 is disposed a rubber scrubber 14. In use, no matter which of the mopping sponge 13 and the rubber scrubber 14 is applied to a floor or a surface, a force must be constantly applied to the floor or surface with a pulling force is exerted at the same time for effective cleaning.

Such a prior art mop has the following disadvantages:

1. It needs relatively a lot of force to use either the mopping sponge 13 or rubber scrubber 14.
2. The mopping sponge 13 and the rubber scrubber 14 are fixed in place and can not be replaced for different purposes.
3. The mop is easily dropped off user's hands as a result of fatigue or exhaust of a user, causing accident when the mop is used to clean glass surfaces of a high building.

SUMMARY OF THE INVENTION

Therefore, the primary object of the present invention is to provide an improved mop which is provided with a sucking plate so as to make the mop firmly stick to a floor or glass surface in use, permitting the mop to be easily moved with less effort in operation.

Another object of the present invention is to provide an improved mop which is provided with a sucking plate attached to a fixing seat, then the fixing seat is removably fixed to a pivotal connector. A pulling cord secured to the sucking plate for releasing the sucking plate off a surface is arranged in such a manner that the mop unit can be moved in circle without tangling in mess.

One further object of the present invention is to provide an improved mop which has a mop unit removably secured to a connector. The connector is pivotally fixed to a long handle so that the mop unit having two different mop surface can be switched with ease according to practical need.

One still further object of the present invention is to provide an improved mop which can be easily attached to a glass surface of a building so that a person can clean a glass surface with ease and less force. Thereby a mop can be held safely for a long time without falling down from a high place in use.

DETAILED DESCRIPTION OF THE PREFERRED EMBODIMENTS

Figure 1:
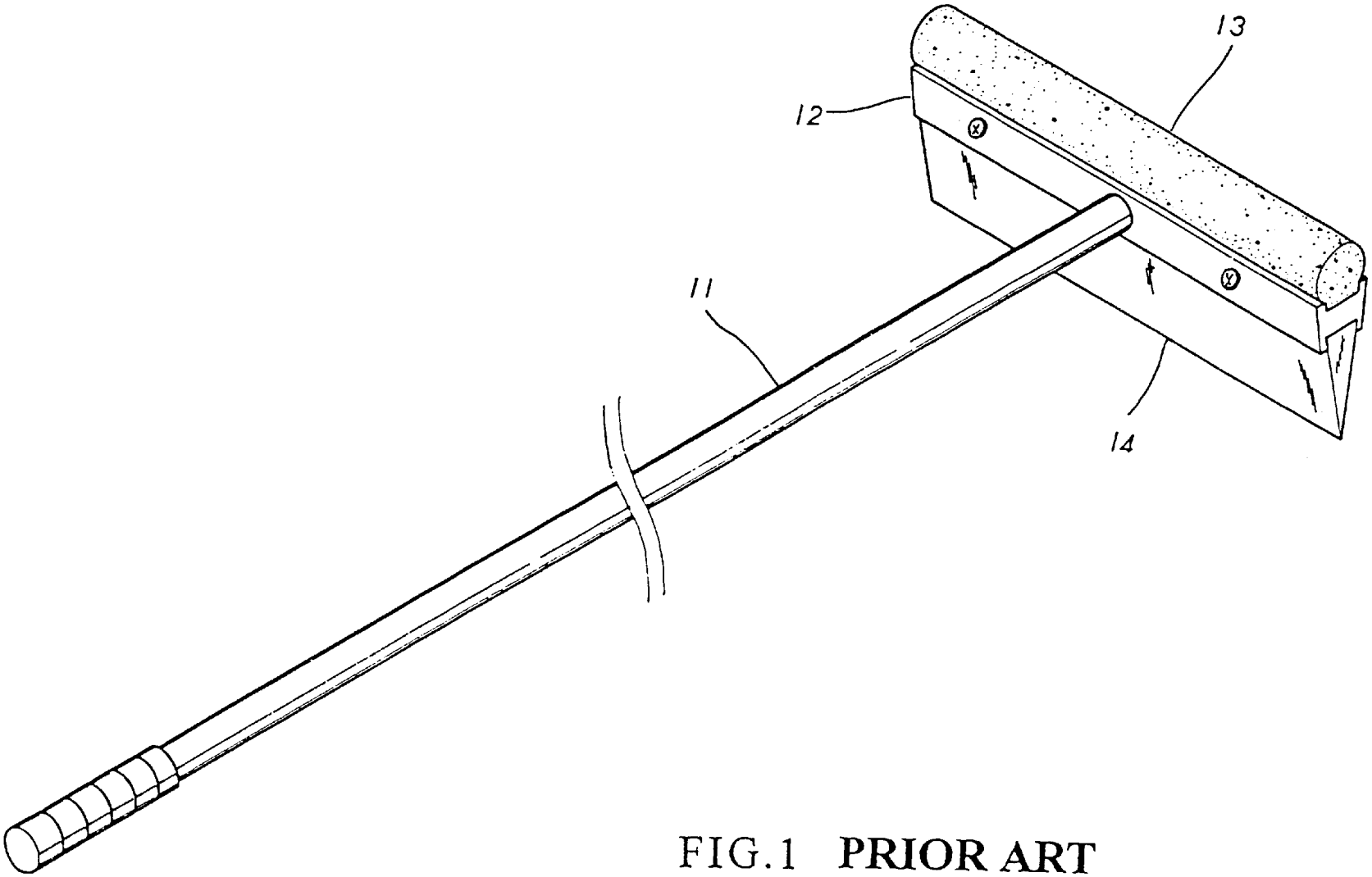
FIG.1 PRIOR ART
FIG. 1 is a perspective diagram showing a conventional mop.
Figure 2:
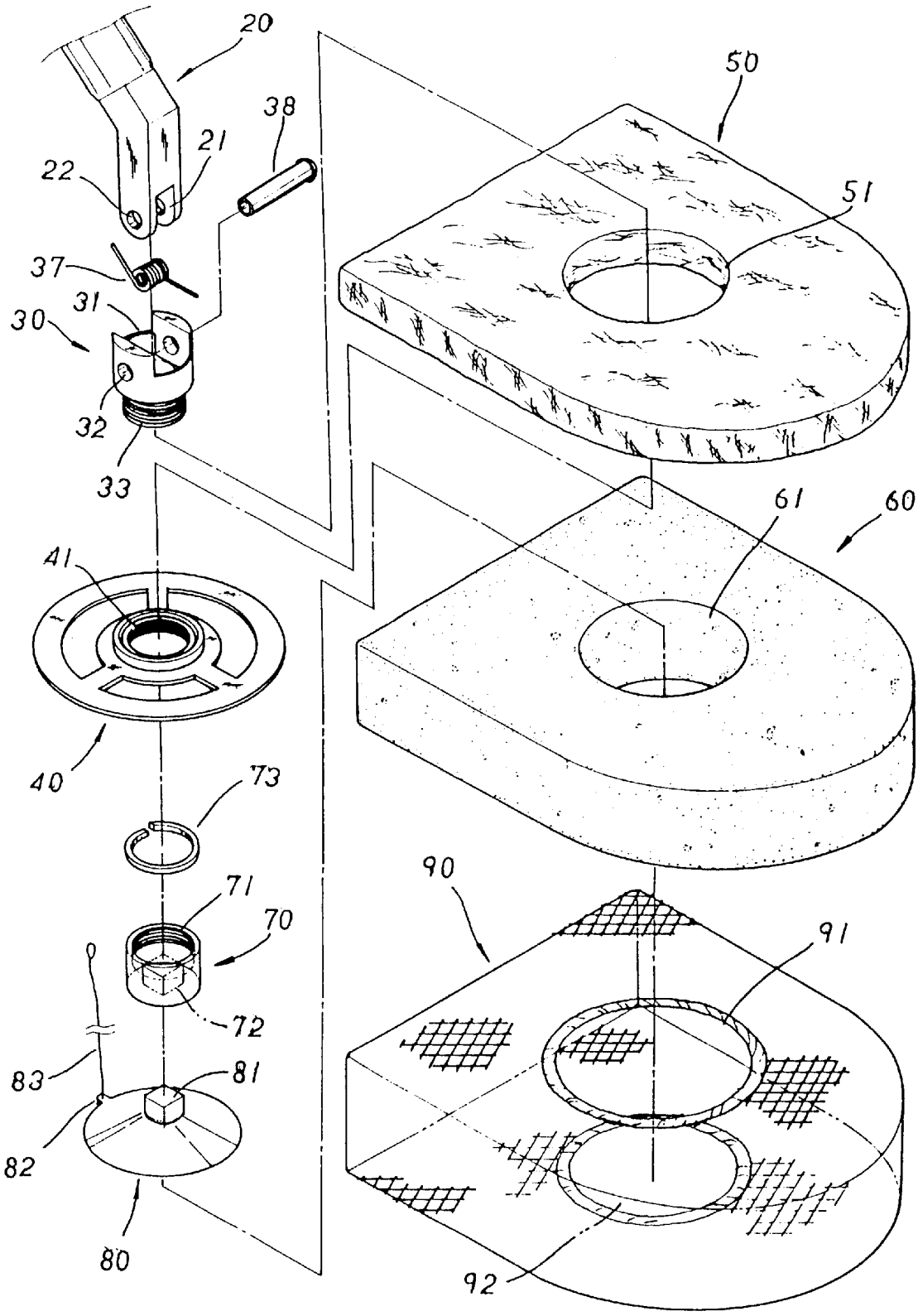
FIG. 2 is a perspective diagram showing the exploded components of the first embodiment of the present invention.

Referring to FIG. 2, the mop of the present invention is equipped with a long handle 20, a connector 30, a torsion spring 37, a rivet 38, a securing ring 40, a coarse sponge 50, a soft sponge 60, a fixing seat 70, a washer ring 73, a sucking plate 80 and a screen housing 90. The front end of the long handle 20 is provided with bifurcated connecting lugs 21 each having a pivot hole 22.

The connector 30 is a bifurcated coupling end 31 which are provided with lugs each having a pivot hole 32. An externally and fully threaded journal end 33 is disposed at the bottom of the connector 30. The securing ring 40 of a proper thickness is provided with a tubular central hole 41 with internal threads defined therein so as to permit the connector 30 to be removably engaged with the securing ring 40. The coarse sponge 50 has a round through hole 51 which has a diameter smaller than the overall diameter of the securing ring 40. In the same manner, the soft sponge 60 is provided with a round through hole 61. The fixing seat 70 is tubular in shape and has an opened top end 71 with an engagement cavity 72 defined at the closed bottom end thereof.

The sucking plate 80 is provided with a raised block 81 having a square cross section, a pull piece 82 disposed at a periphery edge thereof has an extension cord 83. A resilient inserting hole 91 is disposed at the center of the screen housing 90 on the top surface thereof and a round hole 92 is placed at the bottom surface thereof.

Figure 3:
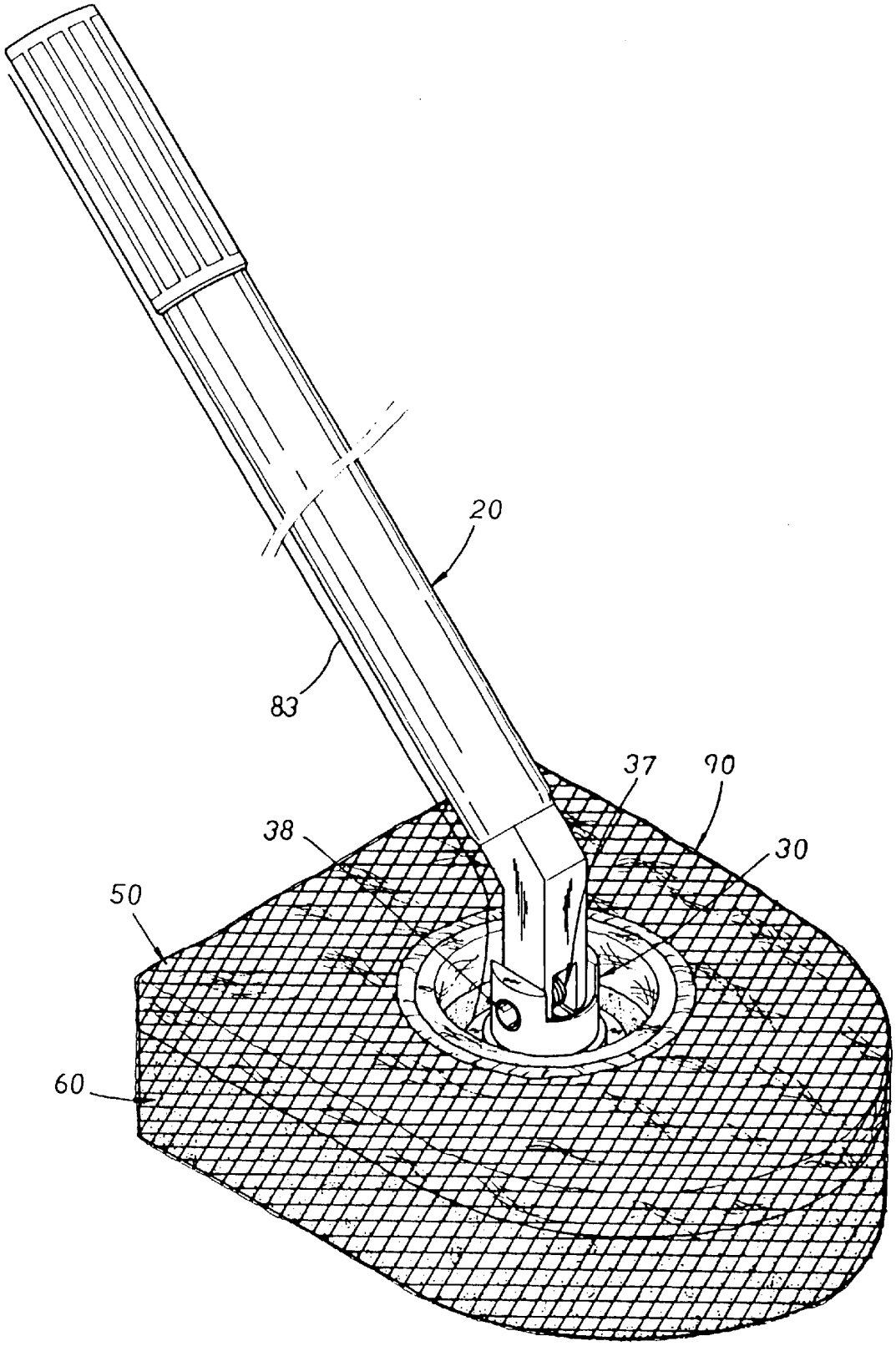
FIG. 3 is a perspective diagram showing the assembly thereof.

Referring to FIG. 3, in assembly, the bifurcated connecting lugs 21 of the long handle 20 and the torsion spring 37 are secured in the bifurcated coupling end 31 of the connector 30 by way of a rivet 38 so as to permit the long handle 20 to be pivotally moved within particular angles. Then the securing ring 40 is placed between the round through hole 51 of the coarse sponge 50 and the round through hole 61 of the soft sponge 60. The coarse sponge 50, the soft sponge 60 and the securing ring 40 are fixed together by glue to form a mop unit having two different cleaning sides. The raised block 81 of the sucking plate 80 is engaged by glue with the engagement cavity 72 of the fixing seat 70. Afterwards, the coarse sponge 50 as well as the soft sponge 60 is attached to the connector 30 by way of the securing ring 40 which is engaged with the externally threaded journal end 33 by the internally threaded tubular central hole 41. The lower end of the journal end 33 is exposed out of the securing ring 40 so as to permit the fixing seat 70 having internal threads 71 with the sucking plate 80 to be attached thereto to be secured to the lower end of the journal end 33 with the washer ring 73 disposed therebetween. The pull cord 83 connected to the pull piece 82 of the sucking plate 80 is led through one of the slots of the securing ring 40 and extends to the rear side of the long handle 20. At last, the flexible screen housing 90 is engaged with the assembled mop unit, making the round holes 91, 92 position in alignment with the round through hole 51 of the coarse sponge 50 and the round through hole 61 of the soft sponge 60 to complete the assembly.

Figure 4:
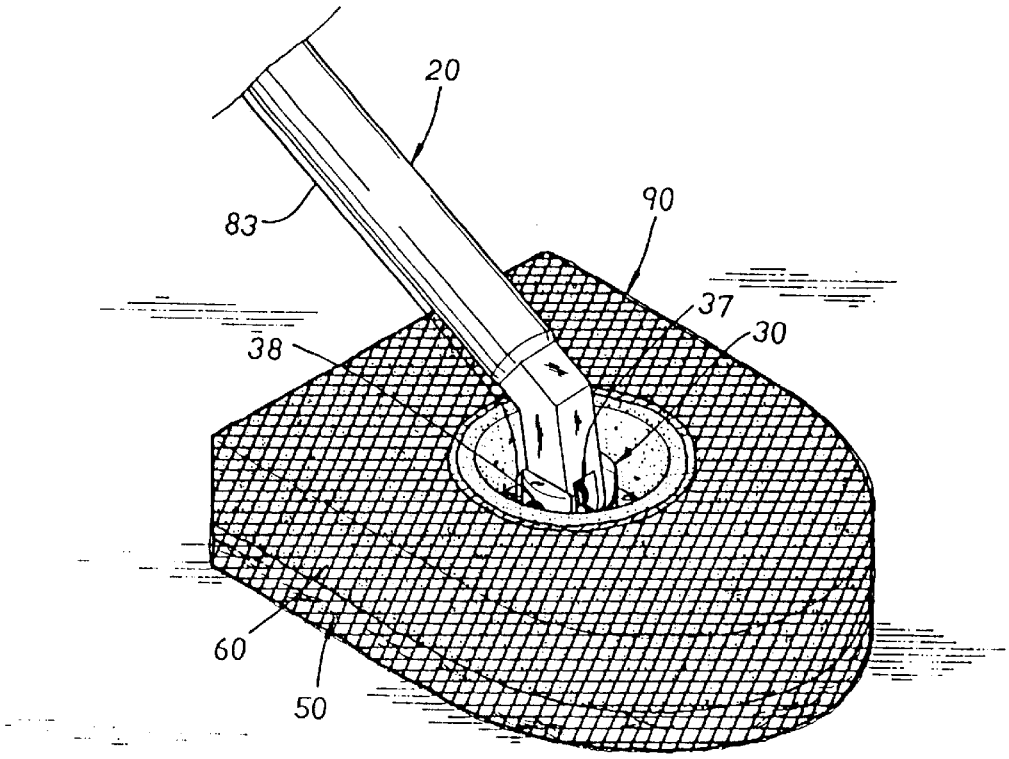
FIG. 4 is a perspective diagram showing the mop of the present invention.
Figure 4A:
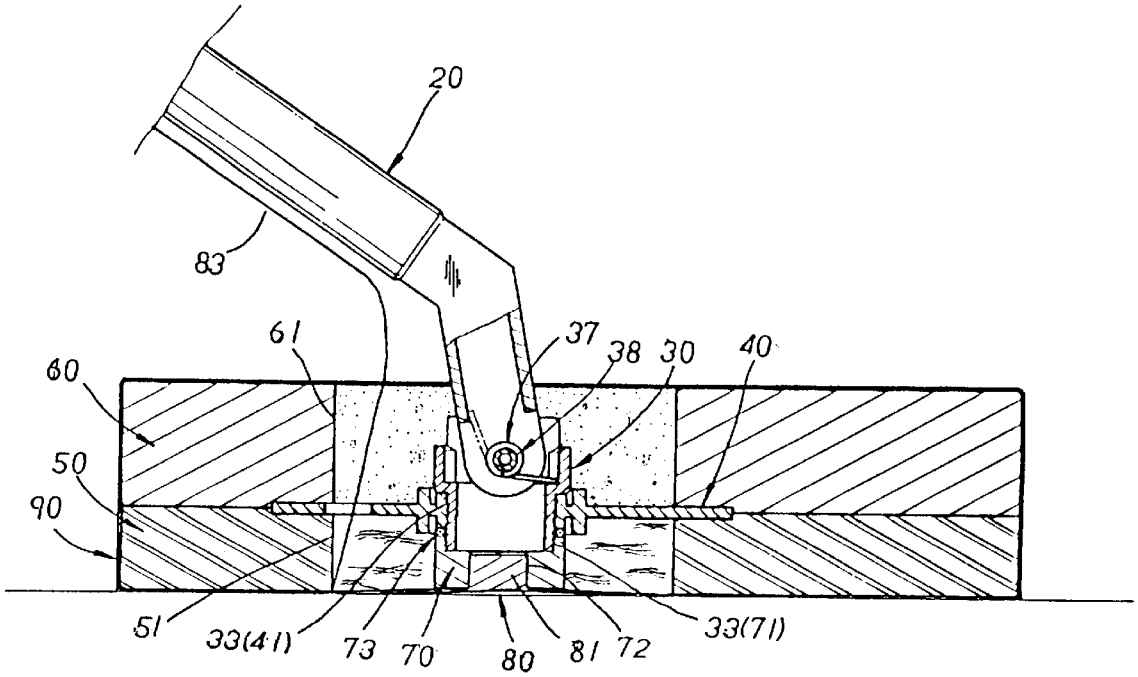
FIG. 4A is a sectional diagram of the first embodiment thereof.
Figure 5:
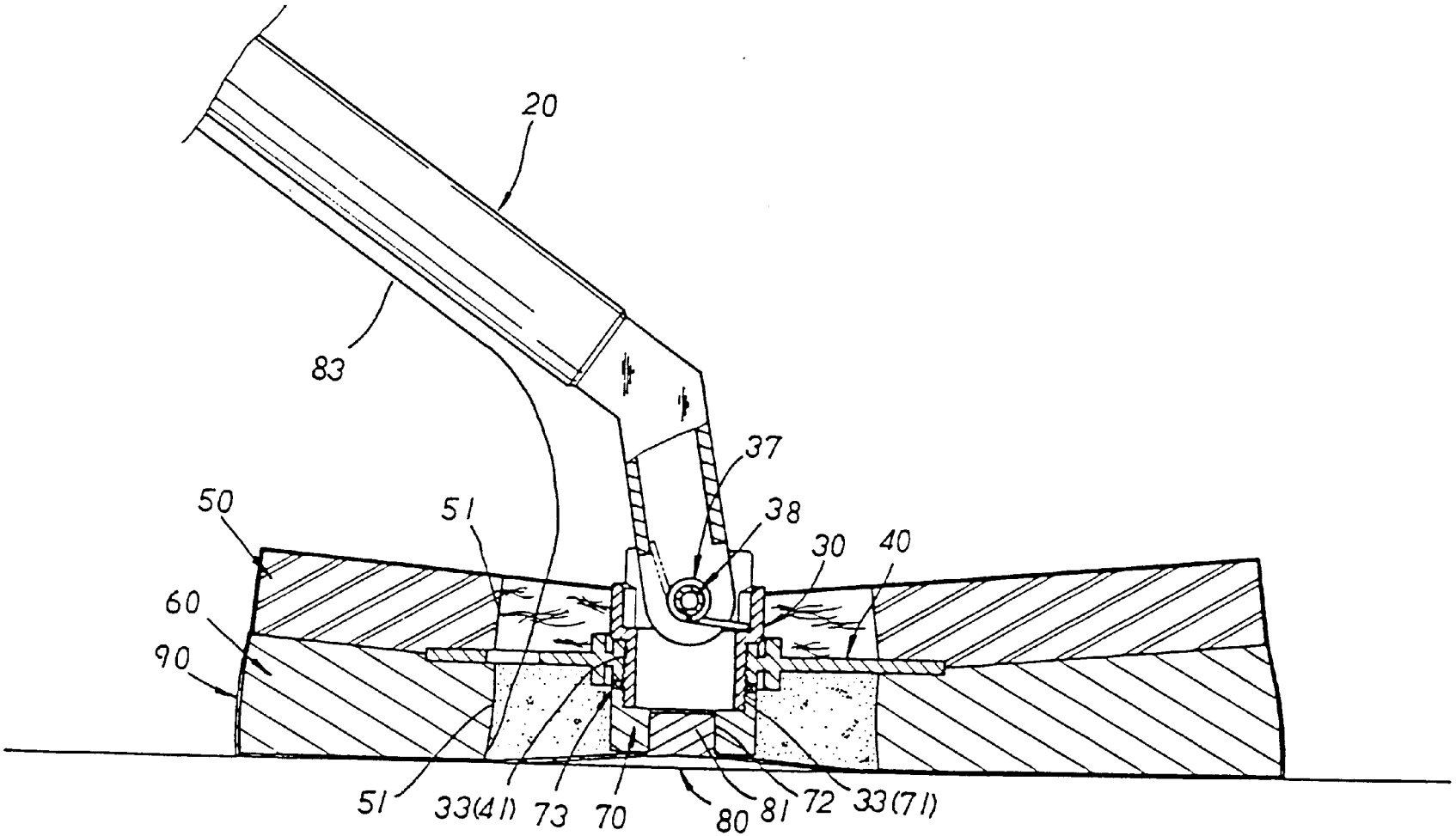
FIG. 5 is a sectional diagram showing another operation mode of the first embodiment.

Referring to FIG. 4, when the coarse sponge 50 is to be applied to a floor or a glass, the mop unit is first plunged in water so as to get the sucking plate 80 to be in sucking engagement with the surface thereof for cleaning operation. To get the sucking plate 80 off the surface, one only has to pull the pull cord 83 to get the sucking plate 80 free. As shown further in FIG. 5, the coarse sponge 50 can be changed to the soft sponge 60 by first taking the screen housing 90 off the mop unit and then screwing the fixing seat 70 to which the sucking plate 80 is attached off the connector 30 having externally threaded journal end 33. Afterwards, the mop unit is turned upside down to get the soft sponge 60 facing down, and get the mop unit screwed into engagement with the journal end 33 of the connector 30. Then, the fixing seat 70 with the sucking plate 80 is engaged with the journal end 33 to lock the mop unit in place. At last, the screen housing 90 is engaged with the mop unit again. In such a manner, the soft sponge 60 can be used to clean a surface in operation.

Figure 6:
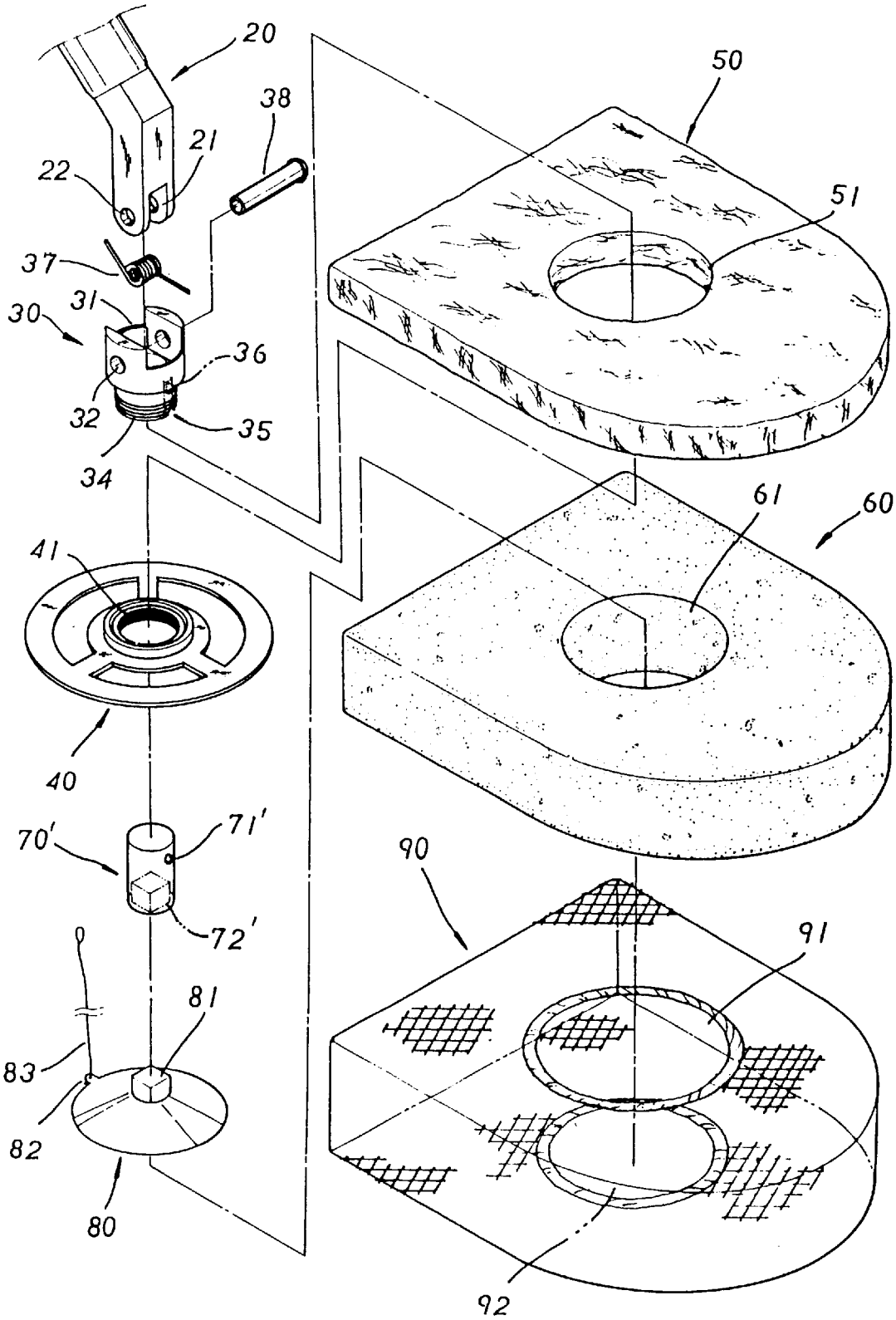
FIG. 6 is a perspective diagram showing the exploded components of the second embodiment of the present invention.
Figure 7:
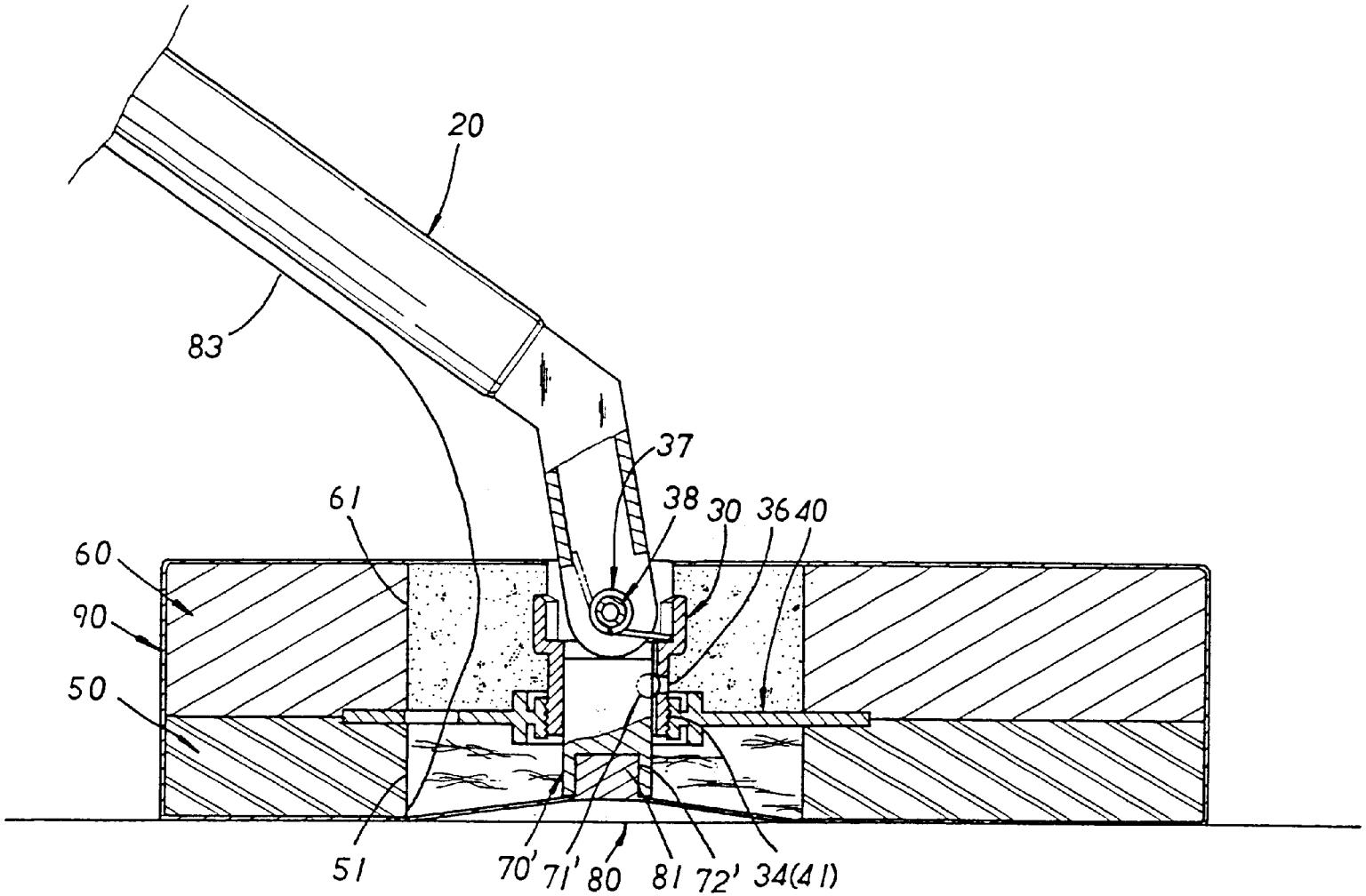
FIG. 7 is a sectional diagram showing the assembly of the second embodiment thereof.

Referring to FIG. 6, a second embodiment is shown, the connector 30 is provided with a partially threaded journal end 34 and at the bottom edge of the journal end 34 is disposed a semi-circular recess 35. A retaining hole 36 is disposed at a position above the semi-circular recess 35. The fixing seat 70 is replaced with a cylindrical rod 70' having a bottom receiving cavity 72' and a locking bead 71' on one side thereof. The washer ring 73 is not used in this case.

The assembly and change of the position of the coarse sponge 50 and soft sponge 60 of the second embodiment are same as that of the first embodiment, so no detailed descriptions of the assembly and change are given. The only difference is the attachment of the cylindrical rod 70' having a bottom receiving cavity 72' with which the raised block 81 of the sucking plate 80 is engaged. The cylindrical rod 70' is inserted into the hollow tubular connector 30 having a retaining hole 36 with which the locking bead 71' is engaged for retaining in place. The detachment of the cylindrical rod 70' is easily done by pushing the exposed locking bead 71' so as to allow the same to separate from the connector 30.

It can be clearly seen that the present invention has the following advantages in practical use:

1. The sucking plate can help the mopping unit firmly stick to floor or a glass surface so that a person does not have to exert too much force in operation.
2. The pulling cord 83 is fixed to the fixing seat 70 which is then secured to the connector 30 so as to prevent the pulling cord 83 from tangling together when the mop is moved in circle.
3. The mopping unit can be easily replaced when damaged in use.
4. The sucking plate 80 can be sucked firmly onto glasses of a high building so that the mop can be retained in place without easily falling down as a result of a person being exhausted from raising the mop high for a long time, causing accident when the dropped mop hits people walking below.

I claim:

1. A mop equipped with a handle, a connector, a torsion spring, a rivet, a securing ring, a coarse sponge, a soft sponge, a fixing seat, a washer ring, a suction plate and a screen housing; a front end of said long handle having bifurcated connecting lugs each having a pivot hole; said connector having a bifurcated coupling end which are provided with lugs each having a pivot hole so as to permit said connector to be pivotally secured to said long handle;

wherein the improvement comprises said securing ring having a proper thickness is fixedly sandwiched between said soft sponge and said coarse sponge and is removably engaged with said connector; said fixing seat is separably engaged with said connector and is located under said securing ring; said suction plate is removably secured under said fixing seat; said soft sponge and said coarse sponge are removably housed in said screen housing in assembly; whereby a mop unit formed of said soft sponge and said coarse sponge and said securing ring having two different cleaning sides and removably housed in said screen housing can be detached from said connector and said mop unit is removed from said screen housing and selectively turned upside down and relocated in said screen housing for cleaning purpose; said suction plate attached to said fixing seat and is adapted to be firmly engaged with a floor or a glass surface in use of said mop so that less force is exerted to hold said mop in use.

2. A mop equipped with a handle, a connector, a torsion spring, a rivet, a securing ring, a coarse sponge, a soft sponge, a fixing seat, a washer ring, a suction plate and a screen housing; a front end of long handle having bifurcated connecting lugs each having a pivot hole; said connector having a bifurcated coupling end which is provided with lugs each having a pivot hole so as to permit said connector to be pivotally secured to said handle;

wherein the improvement comprises an externally threaded journal end disposed at the bottom of said connector; said securing ring having a proper thickness is provided with a tubular central hole with internal threads defined therein so as to permit said connector to be removably engaged with said securing ring; said coarse sponge has a round through hole which is smaller in diameter than the overall diameter of said securing ring; said soft sponge is provided with a round through hole; said fixing seat is tubular in shape and has an opened top end with an engagement cavity defined at the closed bottom end thereof; said suction plate is provided with a raised block having a square cross section, a pull piece disposed at a periphery edge thereof has an extension cord; a resilient insertion hole is disposed at the center of the screen housing on a top surface thereof and a round hole is placed at the bottom surface thereof; said bifurcated connecting lugs of said long handle and said torsion spring are secured in said bifurcated coupling end of said connector by way of a rivet so as to permit said long handle to be pivotally moved within particular angles; said securing ring is placed between a round through hole of said coarse sponge and a round through hole of said soft sponge;

said coarse sponge, said soft sponge and said securing ring are fixed together by glue to form a mop unit having two different cleaning sides; a raised block at a top.of said suction plate is engaged by glue with an engagement cavity of said fixing seat; said coarse sponge as well as said soft sponge is attached to said connector by way of said securing ring which is engaged with the externally threaded journal end by said internally threaded tubular central hole; said lower end of the journal end is exposed out of said securing ring so as to permit said fixing seat having internal threads with said suction plate to be attached thereto to be secured to the lower end of the journal end with said washer ring disposed therebetween; a pulling cord connected to said pull piece of said suction plate is led through one of the slots of said securing ring and extends to the rear side of said long handle; said flexible screen housing is engaged with the assembled mop unit.

3. A mop equipped with a handle, a connector, a torsion spring, a rivet, a securing ring, a coarse sponge, a soft sponge, a fixing seat, a suction plate and a screen housing; a front end of said long handle having bifurcated connecting lugs each having a pivot hole; said connector having a bifurcated coupling end which are provided with lugs each having a pivot hole so as to permit said connector to be pivotally secured to said long handle;

wherein the improvement comprises said securing ring having a proper thickness is fixedly sandwiched between said soft sponge and said coarse sponge and is removably engaged with said connector; said fixing seat is separably engaged with said connector and is located under said securing ring; said suction plate is removably secured under said fixing seat; said soft sponge and said coarse sponge are removably housed in said screen housing in assembly; whereby a mop unit formed of said soft sponge and said coarse sponge and said securing ring having two different cleaning sides and removably housed in said screen housing can be detached from said connector and said mop unit is removed from said screen housing and selectively turned upside down and relocated in said screen housing for cleaning purpose; said suction plate attached to said fixing seat and is adapted to be firmly engaged with a floor or a glass surface in use of said mop so that less force is exerted to hold said mop in use; and wherein said connector is provided with a partially threaded journal end and at the bottom edge of said journal end is disposed a semi-circular recess; a retaining hole is disposed at a position above said semi-circular recess; said fixing seat is a cylindrical rod having a bottom receiving cavity and a locking bead on one side thereof; said rod having a bottom receiving cavity with which said raised block of said sucking plate is engaged; said cylindrical rod is inserted into said hollow tubular connector having a retaining hole with which said locking bead is engaged for retaining in place; detachment of said cylindrical rod is easily done by pushing said exposed locking bead so as to allow the same to separate from said connector.

* * * * *